United States Patent [19]

Babbage et al.

[11] Patent Number: 4,467,778

[45] Date of Patent: Aug. 28, 1984

[54] COAL AND WOOD BURNING STOVES

[75] Inventors: Thomas A. Babbage, Walton-on-Thames; Frederick W. Cousins, Fetcham, both of England

[73] Assignee: Trianco Redfyre Limited, Leatherhead, England

[21] Appl. No.: 422,100

[22] Filed: Sep. 23, 1982

[30] Foreign Application Priority Data

Oct. 5, 1981 [GB] United Kingdom ..... 8130064

[51] Int. Cl.[3] ..... F24C 1/02; F23H 7/14; F23H 7/16

[52] U.S. Cl. ..... 126/77; 126/152 B; 126/155; 126/157; 126/191; 126/200

[58] Field of Search ..... 126/77, 152 R, 152 B, 126/155, 157, 161, 163 R, 181

[56] References Cited

U.S. PATENT DOCUMENTS

| | | | |
|---|---|---|---|
| 340,278 | 4/1886 | Brielmair | 126/146 X |
| 1,169,119 | 1/1916 | Brewer | 126/15 R |
| 1,742,081 | 12/1929 | Kandle | 126/155 X |
| 1,944,336 | 1/1934 | Watson | 126/152 R |
| 2,116,322 | 5/1938 | Muir et al. | 126/163 R X |
| 2,814,287 | 11/1957 | Shults | 126/140 |
| 4,258,692 | 3/1981 | Mackey | 126/152 B X |
| 4,426,992 | 1/1984 | Martenson | 126/77 |

FOREIGN PATENT DOCUMENTS

| | | | |
|---|---|---|---|
| 972068 | 1/1951 | France | 126/155 |
| 2056052 | 3/1981 | United Kingdom | 126/200 |

*Primary Examiner*—Samuel Scott
*Assistant Examiner*—Kenichi Okuno
*Attorney, Agent, or Firm*—Shoemaker and Mattare, Ltd.

[57] ABSTRACT

The invention provides a stove for burning a charge of fuel by primary air directed either above or underneath through the firebed. A firebed support is defined by an array of alternating fixed and movable bars, the movable bars having a length greater than their width when viewed endwise and being rotatable between a vertical attitude in which they permit upward passage of air and downward passage of ash through said support and a horizontal attitude in which they permit build up of a layer of ash at the base of the firebed. An air distribution chamber has an inlet for primary air, a first outlet from which primary air passes to a space above the firebed and a second outlet from which primary air passes to a space below the firebed. An air diversion flap is movable between positions in which air is selectively directed through the first and through the second outlet. Control means operatively connects to the movable bars and to the air diversion flap to maintain them in an interlocked relationship so that the stove may be altered between one state in which the movable bars are directed generally horizontally and primary air passes through the first outlet and a second state in which the movable bars are directed generally vertically and primary air passes through the second outlet. Furthermore the stove has a housing having a generally upright front wall in which is formed an aperture for charging fuel and also for exposure of the firebed to permit enjoyment of its radiant heat and a firedoor that in a lowered position closes off the aperture. The firedoor is supported at either side on arms pivoted to opposed sides of the housing and spring loaded to balance the weight of the door. A top canopy has a front wall that defines with the upper region of the front wall of the housing a slot into which the firedoor may be raised clear of the aperture and concealed.

11 Claims, 10 Drawing Figures

COAL AND WOOD BURNING STOVES

FIELD OF THE INVENTION

The present invention relates to a stove that is purposely built to burn coal or wood and can also burn similar fuels such as peat.

BACKGROUND TO THE INVENTION

There has recently been a considerable revival of interest in wood-burning stoves for room heating and also for space heating eg. with a built in water jacket to heat central heating radiators. But wood is not always available or may not be available at an appropriate price and it is usual to provide a grate so that the stove can also burn coal. But this is not a complete solution because a stove that is specifically designed to burn wood efficiently will not burn coal with equal efficiency because a different flow pattern of primary combustion air is required. Thus when burning wood it is desirable that the primary air should pass over the firebed and not through it, and a heat-retaining layer of ash may be allowed to build up at the base of the firebed. But when burning coal the primary air should pass below the firebed and flow up through it and ash and clinker have to be riddled out at relatively frequent intervals. One object of the invention is to provide a stove that may be switched at will between an efficient wood-burning state and an efficient coal-burning state.

Most current wood burning stoves have a firebed aperture that is closed off by a pair of side pivoted doors which may contain glass so that the firebed can be seen when the doors are closed. Opening of these side pivoted doors when the stove is in use so that radiant heat can escape into the room is unsightly and can be dangerous because it exposes the heated inner surface of the door. It is therefore another object of the invention to provide an improved and inherently safer door construction.

SUMMARY OF THE INVENTION

In one aspect the invention provides a stove for burning a charge of fuel by primary air directed either above or underneath through the firebed comprising a firebed support defined by an array of alternating fixed and movable bars, the movable bars having a length greater than their width when viewed endwise and being rotatable between a vertical attitude in which they permit upward passage of air and downward passage of ash through said support and a horizontal attitude in which they permit build up of a layer of ash at the base of the firebed, an air distribution chamber having an inlet for primary air, a first outlet from which primary air passes above the firebed and a second outlet from which primary air passes below the firebed, an air diversion flap that is movable between positions in which air is selectively directed through the first and through the second outlet and control means operatively connected to the movable bars and to the air diversion flap to maintain them in an interlocked relationship so that the stove may be altered between one state in which the movable bars are directed generally horizontally and primary air passes through the first outlet and a second state in which the movable bars are directed generally vertically and primary air passes through the second outlet.

It has been found experimentally that merely directing the air flow is not enough to give satisfactory wood and coal burning characteristics. It is necessary to adjust the firebed, and an array of fixed and moving bars is in practice necessary for satisfactory results.

In another aspect the invention provides a stove for burning wood, coal or like combustible fuel including a housing having a generally upright or slightly inclined front wall in which is formed an aperture for charging fuel and also for exposure of the firebed to permit enjoyment of its radiant heat, a firedoor that in a lowered position closes off the aperture and supported at either side on arms pivoted to opposed sides of the housing and spring loaded or counterbalanced to balance the weight of the door, and a top canopy having a front wall that defines with the upper region of the front wall of the housing a slot into which the firedoor may be raised clear of the aperture and concealed. This arrangement in which the firedoor is concealed in the raised position is simple, attractive and has manifest safety benefits because the hot firedoor is concealed behind the relatively cool top canopy.

BRIEF DESCRIPTION OF DRAWINGS

An embodiment of the invention will now be described, by way of example only, with reference to the accompanying drawings, in which.

DESCRIPTION OF PREFERRED EMBODIMENT

Figure 1:
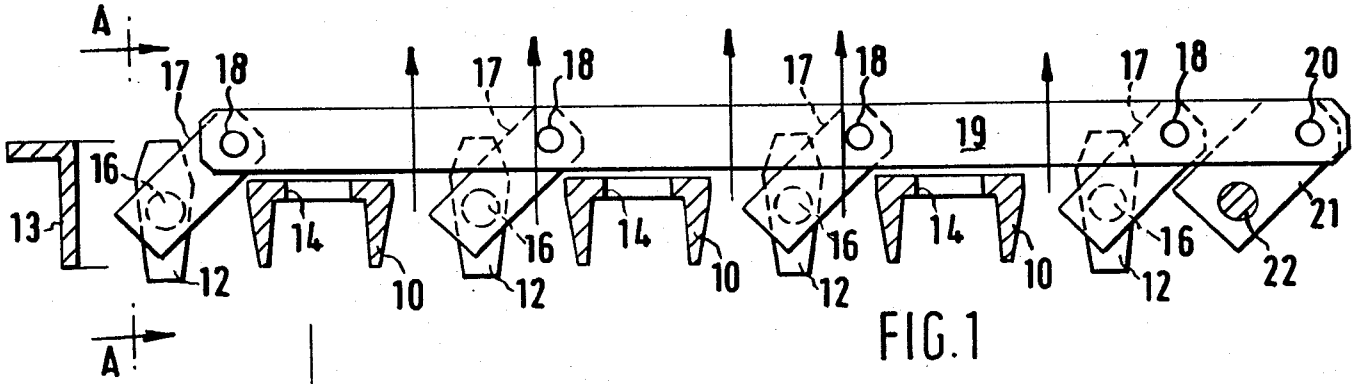
FIG. 1 is a view of the fire-bed of a coal and wood burning stove in transverse section with movable fire bars in a coal-burning position.
Figure 3:
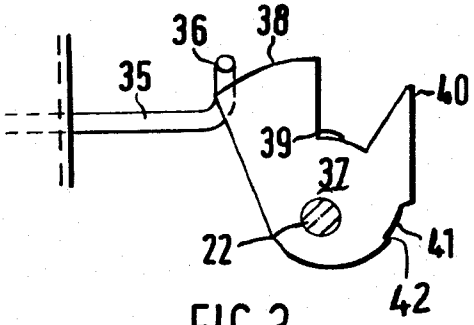
FIG. 3 is a view of an air diverter flap actuating cam and its associated follower bar in the coal-burning position.
Figure 4:
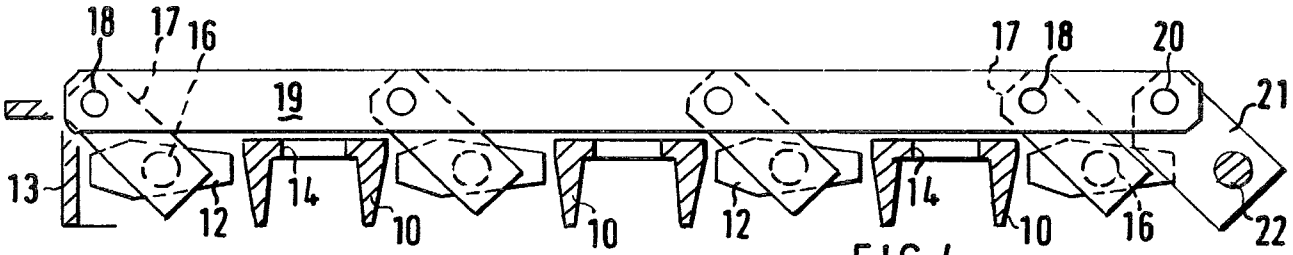
FIGS. 4 to 6 are views corresponding to FIGS. 1 to 3 but in the wood-burning position.
Figure 6:
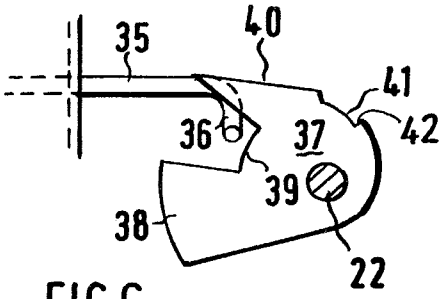
Figure 8:
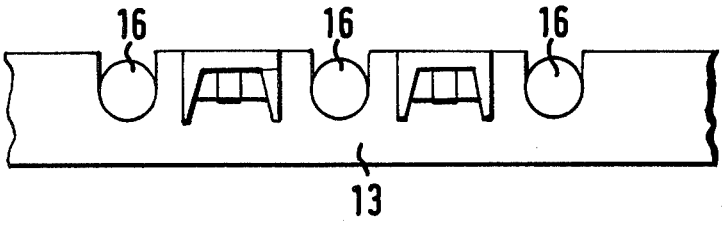
FIG. 8 is a diagram showing how the fixed and movable fire bars fit in the cradle or surround of the fire-bed.
Figure 9:
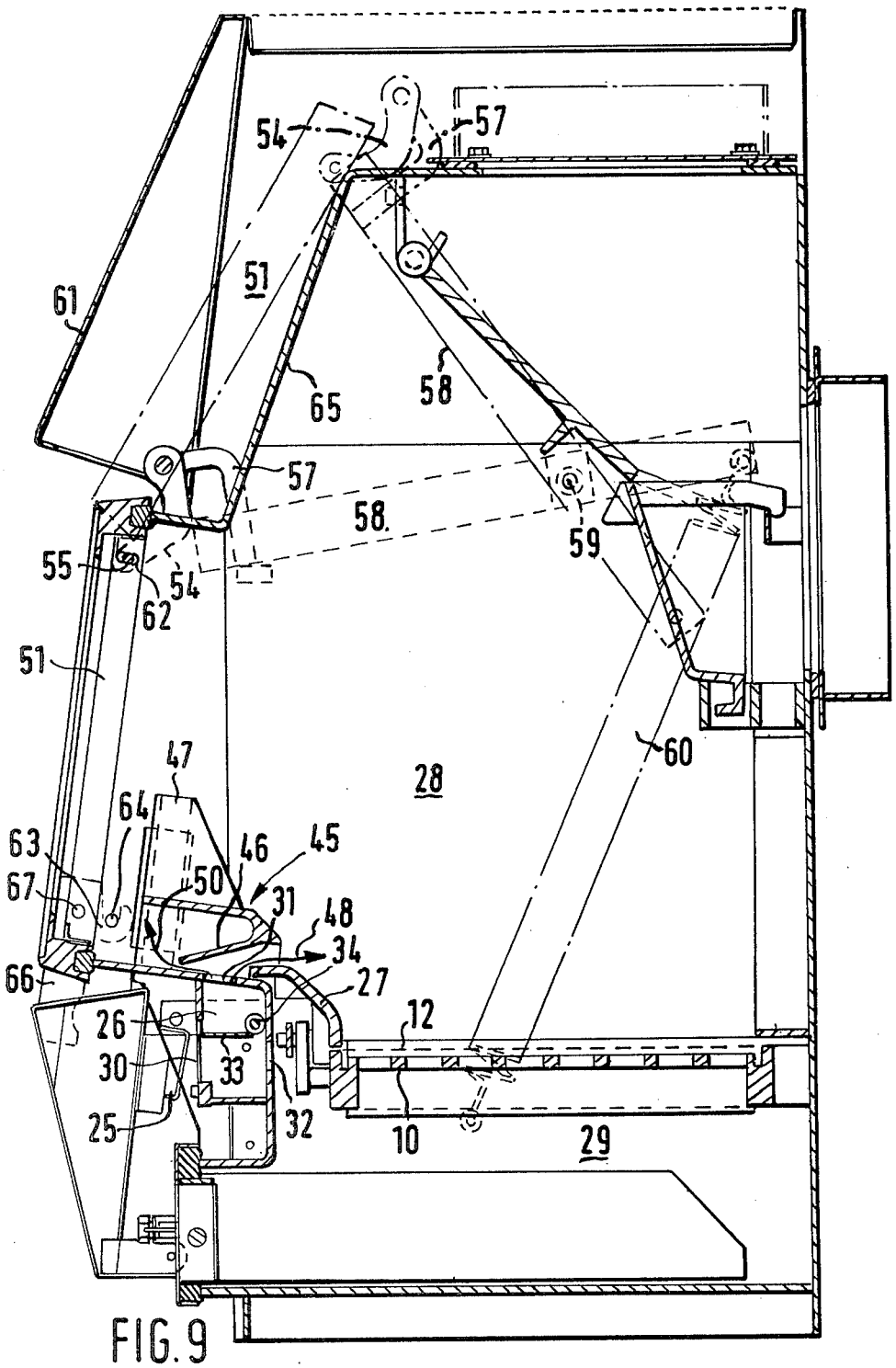
FIG. 9 is a side section of the stove showing the door mechanism.
Figure 10:
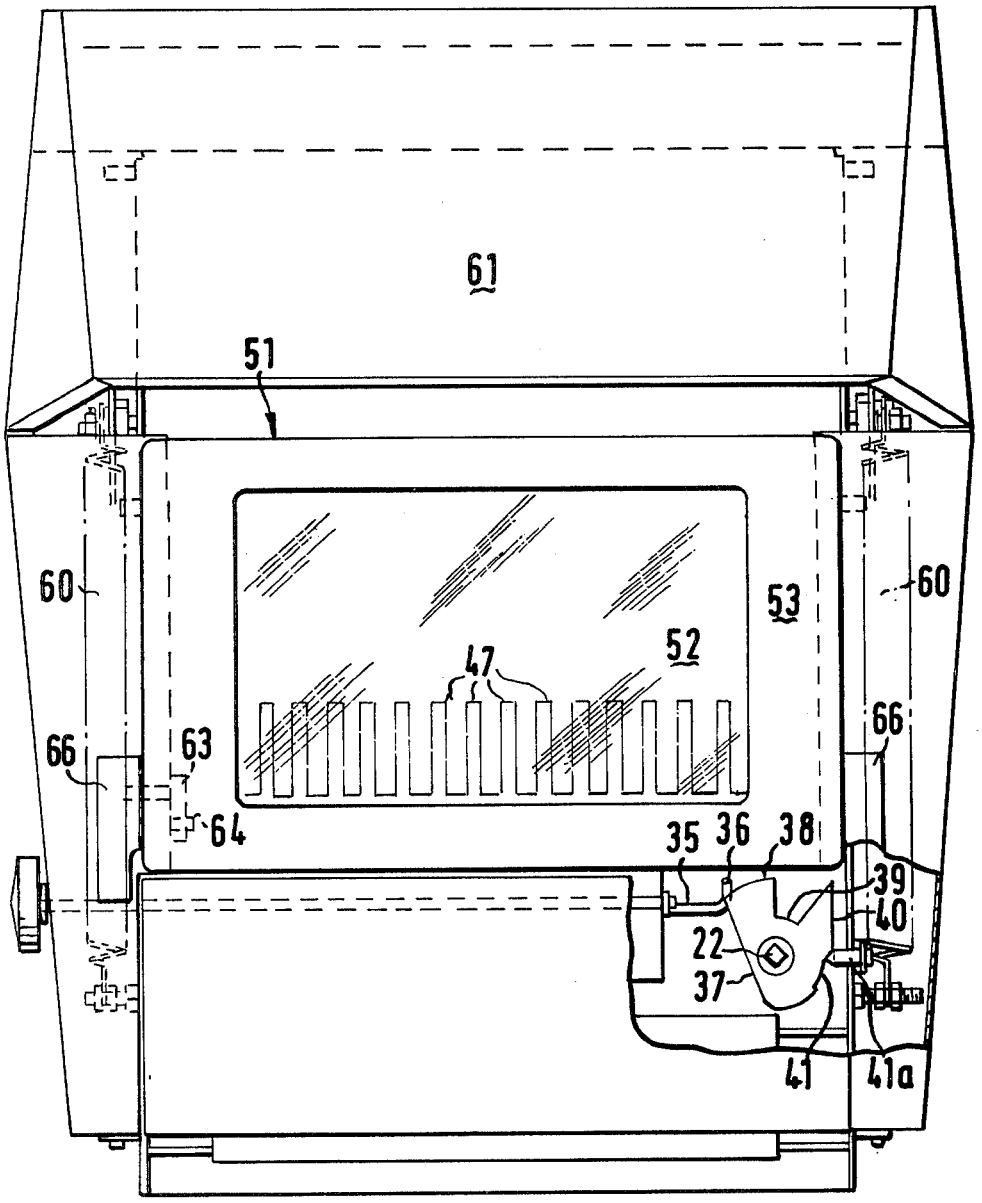
FIG. 10 is a front view of the stove with the door in the lowered position.

In FIGS. 1, 9 and 10 the firebed of a coal and wood burning stove consists of an alternating array of fixed bars 10 and movable bars 12 that fit into a fire bed frame or surround 13. The bars 10 simply slot into the frame or surround 13, are of generally channel shape when viewed in section with a generally planar upper surface presented to the firebed and downwardly converging sides as shown to facilitate downward passage of ash. Holes 14 are formed at regular intervals along the bars 10 to permit upward passage of air through the bars 10 when the stove is in its coal burning mode, but are not of a size that readily permits passage of unburnt fuel. Alternating with the fixed bars 10 are the movable bars 12 that are generally coffin-shaped in end view, the region of maximum width corresponding, in the bars, upright attitude of FIG. 1, with the top of the movable bars 14 to give desirable retention of unburnt fuel and unobstructed passage of ash falling below the fire bed. The bars 12 have at opposite ends pivot shafts 15, 16, the shaft 16 having a crank arm 17 terminating in a crank pin 18. The Shafts 15, 16 are rotatably supported in U-shaped recesses in the fire bed frame 13 as shown in FIG. 8. Desirably the bar 12, the shafts 15, 16 and the crank arm 17 and pin 18 are formed integrally e.g. by casting. The crank pins 18 of the several arms 17 are received in a common connecting rod 19. The extremity of rod 19 receives a pin 20 of a further crank arm 21 that is rotatable by an actuating shaft 22. Thus 90° movement of the shaft 22 is arranged to bring about simultaneous rotation of the several interlinked bars 12 between their upright attitude (FIG. 1) and their horizontal attitude (FIG. 4). In the coal burning attitude (FIG. 1) air can pass upwardly through the relatively wide spaces between the bars 10, 12 as indicated by arrows and correspondingly ash can fall downwards into an ash-receiving pan (not shown) beneath the firebed. But in the wood burning attitude (FIG. 4) the sides of the bars 12 support the firebed and the restricted space between the bars 10, 12 permits build up of a layer of ash which is desirable for heat retention and only needs to be discharged at infrequent intervals, typically once per week.

Figure 2:
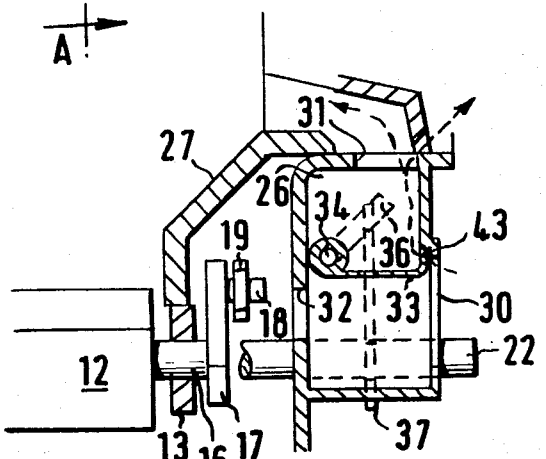
FIG. 2 is a section of the fire-bed on the line A—A of FIG. 1 further showing the air duct and part of a throat formed in a deepening bar that sits over the air duct at the front of the bed.
Figure 5:
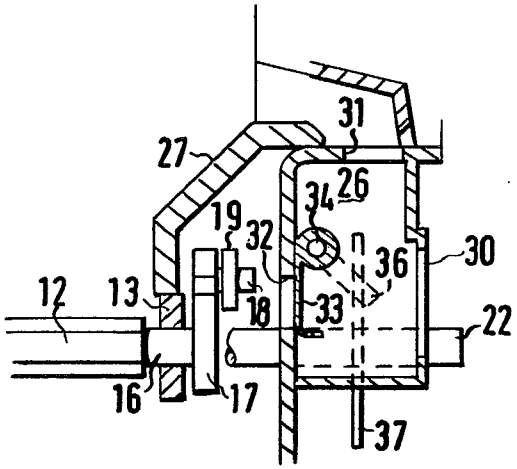
Figure 7:
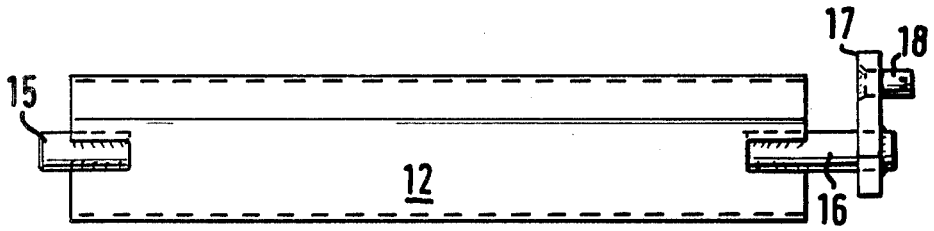
FIG. 7 is a plan view of a movable fire bar and its associated crank arm.

Referring now also to FIG. 9, air enters the stove through a thermostat or a manually controlled flap generally indicated at 25 and enters a distribution chamber 26 which is shielded from the firebed by a front protection plate 27. For the burning of wood the primary combustion air is required to pass upwards from the chamber 26 into the space 28 above the firebed. But for the burning of coal the primary combustion air is required to pass into a space 29 beneath the firebed and then upwardly through the firebed. The chamber 26 has a air inlet at 30 and top and side air outlets 31 and 32 that communicate with the spaces 28 and 29 respectively. An air diverter flap 33 pivoted at 34 within the chamber 26 is moveable between a raised position (FIG. 2) in which it blocks off the air outlet 31 and a lowered position (FIG. 5) in which it blocks off the air outlet 32. The flap 33 is connected to an operating rod 35 having a cranked end 36 that acts as a follower for a cam 37 that is also rigidly connected to the actuated shaft 22. The cam 37 has a raised sector 38 on which the follower end 36 travels when the flap 33 is in its raised position, a cutout sector 39 that permits the flap 39 to fall to its lowered (FIG. 5) position and a kick-down sector 40 that bears on the end 36 and ensures that the flap 33 has moved fully down and does not stick in a partially raised position. It will be noted that the sector 38 is of appreciable angular extent and this permits limited angular movement of the bars 12 with the flap 33 remaining in the raised position. Accordingly the firebed can be riddled within the limits of cam movement to remove ash without changing the flow path of combustion air. Limits of movement of shaft 22 and hence also of cam 37 in the coal-burning state are indicated by a detent 41*a* that runs in a detent channel 41. A positive ramp 42 in the detent channel defines the change from the coal-burning to wood-burning state.

Because the cam 37 and the crank arm 21 are both actuated by the shaft 22 the bars 12 and the flap 33 are interlocked, so when the bars 12 are in their vertical attitude the flap 33 is raised and when the bars 12 are in their horizontal attitude the flap 33 is lowered. Accordingly the firebed state and airflow pattern are always appropriate either for the burning of coal or for the burning of wood. But it will be noted from FIG. 2 that when the flap 33 is raised there remains a small bleed opening 43 through which secondary air can pass to the top opening 31 and into the space 28 as shown by the dotted arrows.

Referring now to FIGS. 9 and 10, there is shown a firebed deepening bar generally indicated as 45 that rests on the chamber 26 and has a base portion 46 and spaced upstanding fingers 47. The base 46 is shaped to define with the top of chamber 26 a flow passage that directs primary air from the outlet 31 into the space 28 as shown by arrow 48. Also the base 46 is formed with a recess that defines a slot for secondary air (arrow 50) that provides a film of air that washes over the inner face of door 51 when the door is in its closed position and prevents build-up of soot thereon. This film of air continues to be present even when the stove is in its coal burning mode by virtue of the bleed opening 43 in the flap 33.

The firedoor 51 has a central glass panel 52 and a metal surround 53. It is suspended from opposite side edges at an upper position by cranked supporting brackets 54 that are pivoted thereto at 55 and at their other ends are pivotally carried on a link bar 57 which extends across the face of the boiler. The ends of the link bar 57 are cranked rearwardly and then downwardly and are fixed in the free ends of arms 58. The arms 58 are pivoted at an intermediate position 59 to the side of the stove and are loaded at the other ends by a spring 60 or counterweight that counterbalances the weight of the door. The top portion of the boiler has a rearwardly inclined face 65 and a top canopy 61 that is spaced from the stove housing and extends in spaced relationship to the face 65. The supporting brackets 54 are formed with elongate slots 62 in which pivot pins 55 of the door 51 are free to travel. Handles 66 at the lower end of the door 51 on either side thereof pivot on pins 67 and operate pawls 63 that engage latch pins 64.

When the firedoor 51 is in its closed position (solid lines) in which it closes a firedoor aperture in the stove casing, the float afforded by the slots 62 enables the firedoor to lie against a heat-resistant resilient seal about the periphery of the firedoor aperture as is required when burning coal, otherwise control of combustion may be lost.

The firedoor 51 will be released from the position shown in solid lines by actuation of the handles 66 after which the door will be raised automatically into the cavity between the top canopy 61 and the face 65 of the stove body and effectively vanishes from sight except for the dependent ends of the handles with its heated inner surface remaining inaccessible. The handles 66 will, of course, be cooler in use than the body of the doors and can be safely touched, and are heat insulated and made of wood or other non-conductive material. The raised position of the door 51, the arms 58 and the corresponding parts are shown in chain dotted lines in FIG. 9. The firedoor opening is thereby exposed for charging of fuel or, if desired, for the enjoyment of direct radiant heat from the burning fuel as in a conventional open fire.

It will be noted that there is an arrangement that permits discharge of flue gases either from a top or from a rear flue opening.

We claim:

1. A stove for burning a charge of fuel by primary air directed either above or underneath a firebed comprising:

a firebed support defined by an array of alternating fixed and movable bars, the movable bars having a depth greater than their width when viewed endwise and being rotatable between a vertical attitude in which they permit upward passage of air and downward passage of ash through said support and a horizontal attitude in which they permit build-up of a layer of ash at the base of the firebed;

an air distribution chamber having means defining an inlet for primary air, means defining a first outlet from which primary air passes above the firebed and means defining a second outlet from which primary air passes below the firebed;

an air diversion flap that is movable between positions in which air is selectively directed through the first and through the second outlet; and control means operatively connected to the movable bars and to the air diversion flap to maintain them in an interlocked relationship so that the stove may be altered between one state in which the movable bars are directed generally horizontally and primary air passes through the first outlet and a second state in which the movable bars are directed generally vertically and primary air passes through the second outlet.

2. A stove according to claim 1, wherein the movable bars are generally of diamond- or coffin-shape in end view.

3. A stove according to claim 2 wherein the movable bars are journalled at each end in a firebed frame or surround and are rigidly connected to respective crank arms moved by a common connecting rod.

4. A stove according to claim 3, further comprising an actuating shaft connected to one end of a crank arm whose other end is connected to the connecting rod whereby rotation of the actuating shaft brings about movement of the connecting rod.

5. A stove according to claim 4, wherein the actuating shaft carries a cam, and a cam follower connected to the air diversion flap effects movement between its two positions on rotation of the actuating shaft.

6. A stove according to claim 5, wherein the cam has a detent channel and a cooperating detent defines the range of angular travel of the movable bars from their vertical state, said detent channel terminating in a ramp indicating movement towards the horizontal state.

7. A stove according to claim 6, wherein means defines a gas flow passage from the first outlet and inclined upwardly towards the space above the firebed.

8. A stove according to claim 7, wherein the flap has means defining a bleed opening so that when primary air is directed through the second outlet a flow of secondary air passes through the first outlet into the space above the firebed.

9. A stove according to claim 8, wherein there is a passage directing a bleed flow of air from the first outlet to a firedoor at the front of the stove.

10. A stove according to claim 9, wherein the firedoor has a glass centre panel and a metal frame.

11. A stove for burning a charge of fuel by primary air directed either above or underneath through the firebed comprising:

a firebed support including movable bars, the movable bars having a depth greater than their width when viewed endwise and being rotatable between a vertical attitude in which they permit upward passage of air and downward passage of ash through said support and a horizontal attitude in which they permit build-up of a layer of ash at the base of the firebed;

an air distribution chamber having means defining an inlet for primary air, means defining a first outlet from which primary air passes above the firebed and means defining a second outlet from which primary air passes below the firebed;

an air diversion flap that is movable between positions in which air is selectively directed through the first and through the second outlet; and control means operatively connected to the movable bars and to the air diversion flap to maintain them in an interlocked relationship so that the stove may be altered between one state in which the movable bars are directed generally horizontally and primary air passes through the first outlet and a second state in which the movable bars are directed generally vertically and primary air passes through the second outlet.

* * * * *